US006666287B2

(12) United States Patent
Holtby

(10) Patent No.: US 6,666,287 B2
(45) Date of Patent: Dec. 23, 2003

(54) METHOD AND APPARATUS FOR ENCLOSING AN OIL DRILLING RIG

(76) Inventor: Quinn Holtby, 3611-111B Street, Edmonton, Alberta, T6J 1G9 (CA)

( * ) Notice: Subject to any disclaimer, the term of this patent is extended or adjusted under 35 U.S.C. 154(b) by 0 days.

(21) Appl. No.: 10/107,497

(22) Filed: Mar. 26, 2002

(65) Prior Publication Data

US 2003/0079914 A1 May 1, 2003

(30) Foreign Application Priority Data

Oct. 26, 2001 (CA) ..... 2,360,234

(51) Int. Cl.[7] ..... E21B 21/10; E21B 15/02

(52) U.S. Cl. ..... 175/209; 175/207; 220/4.12; 220/9.4; 137/312; 166/363

(58) Field of Search ..... 175/207, 209, 175/210, 211, 219; 588/900; 220/4.12, 4.26, 9.4; 137/312, 314; 141/86; 166/363

(56) References Cited

U.S. PATENT DOCUMENTS

| | | | | |
|---|---|---|---|---|
| 1,233,784 A | | 7/1917 | Hutchison | |
| 1,507,628 A | * | 9/1924 | Schuyler | 166/84.1 |
| 1,943,191 A | * | 1/1934 | Schwemlein | 220/565 |
| 2,783,970 A | * | 3/1957 | Gillespie | 137/899.2 |
| 3,374,929 A | | 3/1968 | Silfverskiöld | 222/105 |
| 4,167,235 A | | 9/1979 | Green | 222/105 |
| 4,492,294 A | | 1/1985 | Ball | 193/25 |
| 4,518,106 A | | 5/1985 | LaFleur | 222/460 |
| 4,520,852 A | * | 6/1985 | Klein | 141/86 |
| 5,004,051 A | * | 4/1991 | Rosendahl et al. | 166/357 |
| 5,114,271 A | * | 5/1992 | Sunderhaus et al. | 405/52 |
| 5,167,277 A | * | 12/1992 | Evans | 166/81.1 |
| 5,186,577 A | * | 2/1993 | Reicin et al. | 405/52 |
| 5,315,721 A | | 5/1994 | Okun | 4/599 |
| 5,343,943 A | * | 9/1994 | Norris et al. | 166/81.1 |
| 5,634,485 A | * | 6/1997 | Holtby | 137/15.01 |
| 6,286,593 B1 | * | 9/2001 | Holtby | 166/81.1 |
| 6,386,225 B1 | * | 5/2002 | Holtby | 137/312 |

* cited by examiner

*Primary Examiner*—David Bagnell
*Assistant Examiner*—Daniel P Stephenson
(74) *Attorney, Agent, or Firm*—Davis & Bujold, PLLC

(57) ABSTRACT

A method of enclosing an oil drilling rig. A first step involves providing a base and a flexible sheet-form covering having a first edge and second edge. A second step involves securing the base to the oil drilling rig and securing the first edge of the covering around a perimeter of the base. A third step involves securing the second edge of the covering to the drilling rig in spaced relation to the base, thereby maintaining the covering in a substantially taut condition forming a tubular enclosure.

14 Claims, 6 Drawing Sheets

METHOD AND APPARATUS FOR ENCLOSING AN OIL DRILLING RIG

FIELD OF THE INVENTION

The present invention relates to a method and apparatus for enclosing an oil drilling rig

BACKGROUND OF THE INVENTION

When drill pipe is tripped from an oil well, the exterior of the drill pipe is covered with oil and the interior of the pipe invariably contains drilling fluid. Environmental regulations relating to the operation of drilling rigs are becoming increasingly strict regarding oil contamination. Some geographical areas in which oil drilling takes place are know for their strong prevailing winds. In such locations, the strong winds tend to blow oil from the drilling rig onto the surrounding environment. For the comfort and safety of the rig hands and the protection of the environment, it has become the practise in the industry to cover an area of a drilling rig working with tarps in a geographical area with strong prevailing winds. The tarps are secured in position by ropes. The installation of the tarps is a time consuming process which takes between 10 and 14 hours, as the rig hands must climb the drilling rig in order to tie the tarps into place with ropes. It is also a dangerous procedure, as there is always a danger of the rig hands falling; especially when the prevailing winds are blowing as they try to climb the drilling rig and unfurl tarps.

SUMMARY OF THE INVENTION

What is required is a quicker and safer method of enclosing an oil drilling rig.

According to one aspect of the present invention there is provided a method of enclosing an oil drilling rig. A first step involves providing a base and a flexible sheet-form covering having a first edge and second edge. A second step involves securing the base to the oil drilling rig and securing the first edge of the covering around a perimeter of the base. A third step involves securing the second edge of the covering to the drilling rig in spaced relation to the base, thereby maintaining the covering in a substantially taut condition forming a tubular enclosure.

According to another aspect of the present invention there is provided a combination which includes an oil drilling rig and a base secured to the oil drilling rig. A flexible sheet-form covering is provided having a first edge and second edge. The first edge of the covering is secured around a perimeter of the base. The second edge of the covering is secured to the drilling rig in spaced relation to the base. This maintains the covering in a substantially taut condition and forms a tubular enclosure.

By following the teachings of the present invention, the drilling rig can rapidly be enclosed in a safe and efficient manner. The base is secured in position, the first edge of the covering is attached to the base, the second edge of the covering is then raised and secured in spaced position to the base to maintain the covering in a taut condition forming the tubular enclosure.

Although beneficial results may be obtained through the use of the invention, as described above, it is preferred that the base be circular and the frame be annular. This results in the covering forming a tubular enclosure which is cylindrical. The cylindrical configuration is viewed as being a structure better able to withstand strong prevailing winds.

Although beneficial results may be obtained through the use of the invention, as described above, it is preferred that the covering have an access opening. This facilitates ease of ingress and egress by personnel to the area enclosed.

Although beneficial results may be obtained through the use of the invention, as described above, it is preferred that the base includes an oil containment basin and that the invention form part of an more comprehensive oil containment and environmental protection system.

Although beneficial results may be obtained through the use of the invention, as described above, it is preferred that the second edge of the covering be secured to a substantially planar peripheral frame. This facilitates the rapid deployment of the covering, as the frame can be suspended by cables from the drilling rig to maintain the covering in a taut condition.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred method of enclosing an area of an oil drilling rig will now be described with reference to FIGS. 1 through 6.

Figure 1:
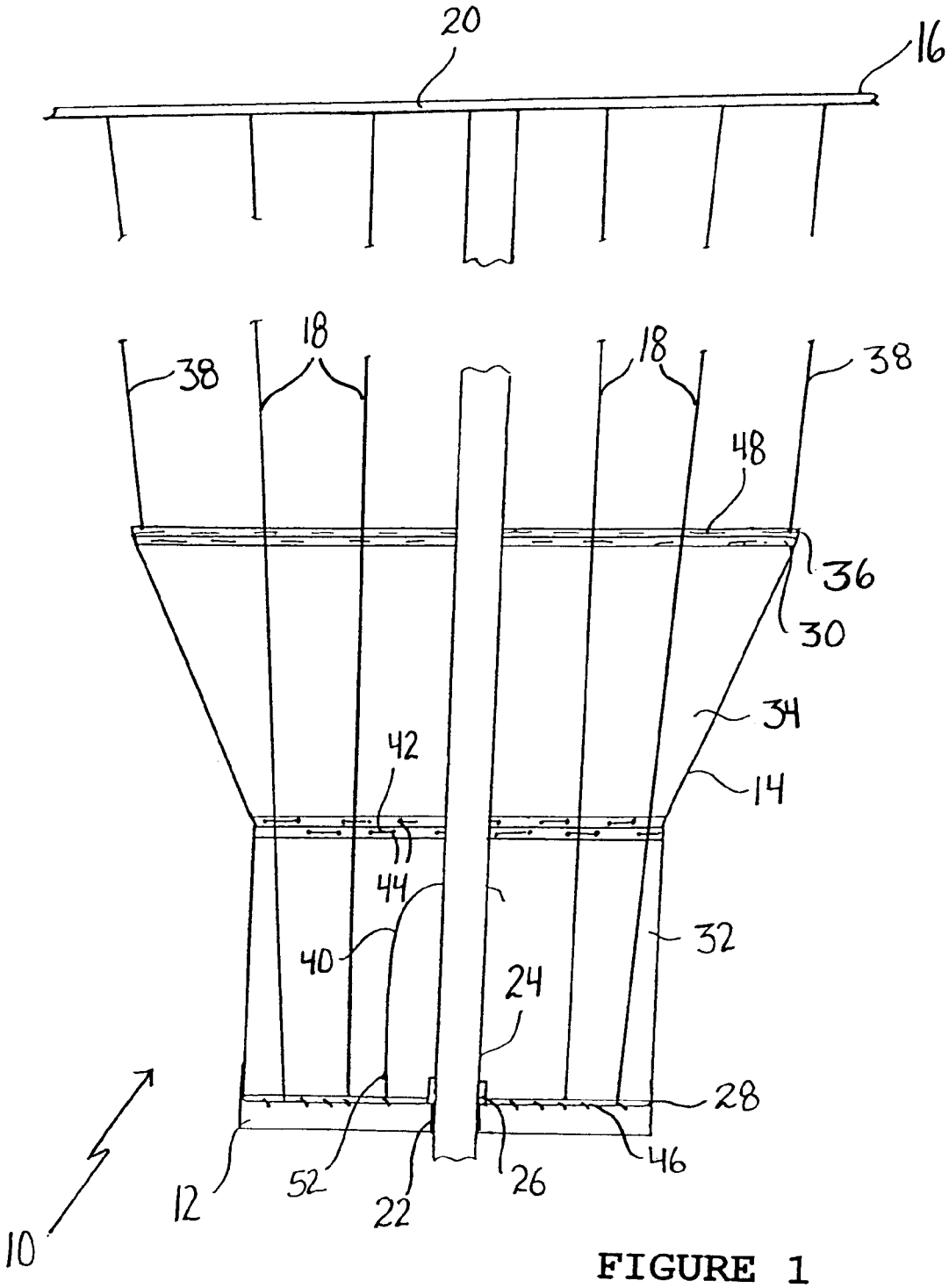
FIG. 1 is a side elevation view, in section, of a portion of a drilling rig enclosed with an apparatus constructed in accordance with the teachings of the present invention.

Structure and Relationship of Parts:

Referring to FIG. 1 there is illustrated an enclosed area of a drilling rig, generally referenced by numeral 10, which includes a circular base 12 and a flexible sheet-form covering 14. In the illustrated embodiment, base 12 is an oil containment basin which is secured to a drilling rig 16 by suspending it by cables 18 at a position approximately 8 feet below a platform 20 of drilling rig 16. Circular base 12 has a central opening 22 to accommodate a drill pipe 24 that extends vertically through enclosed area 10. Clamps 26 are used to secure circular base 12 to drill pipe 24.

Flexible sheet-form covering 14 has a first edge 28 and second edge 30. In the illustrated embodiment flexible sheet-form covering 14 includes a lower portion 32 and an upper portion 34, although it will be appreciated that flexible sheet-form cover 14 could be of a single portion, or could be include more than two portions. First edge 28 of covering 14 is secured around a perimeter circumference of base 12. In the illustrated embodiment, second edge 30 of covering 14 is secured around a perimeter circumference of a circular frame 36. Frame 36 is suspended by cables 38 from platform 20 of drilling rig 16 to maintain frame 36 in spaced relation to base 12 with covering 14 in a substantially taut cylindrical configuration. It will be appreciated that cables 38 could be secured directly to second edge 30 of covering 14 without the use of frame 36 and still maintain covering 14 in a substantially taut cylindrical configuration.

Covering 14 also has an access opening 40 in lower portion 32 thereby facilitating ease of ingress and egress by personnel.

Figure 2:
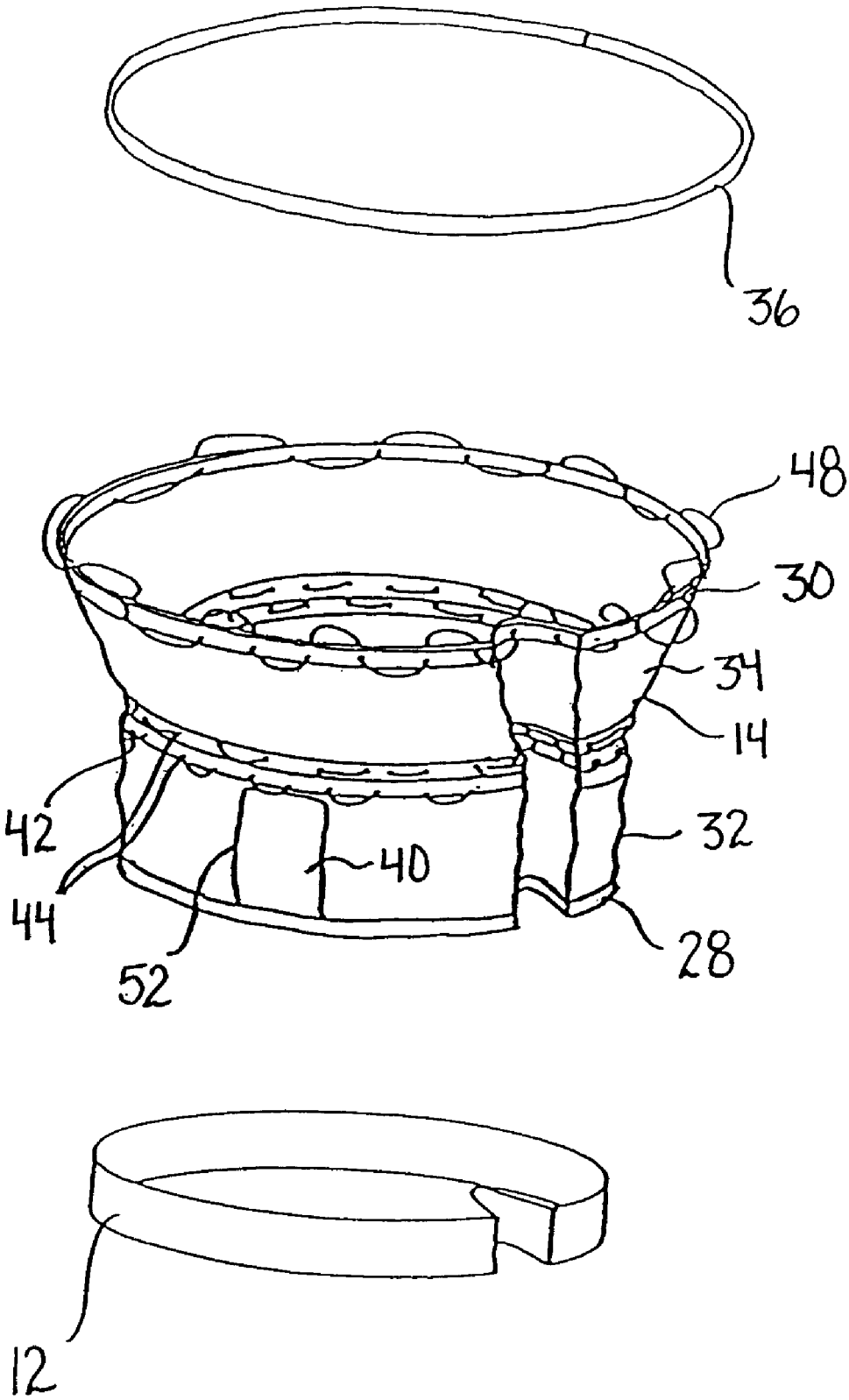
FIG. 2 is an exploded perspective view of the apparatus illustrated in FIG. 1.

Operation:

The use and operation of covering 14 for enclosing an area 10 of oil drilling rig 16 will now be described with reference to FIGS. 1 through 6. Referring to FIG. 2, base 12, frame 36, and covering 14 as described above, are provided for enclosing area 10 of oil drilling rig 16. Lower portion 32 and upper portion 34 of covering 14 are secured together by threading a first cable 42 through eyelets 44 located on lower portion 32 and upper portion 34.

Figure 3:
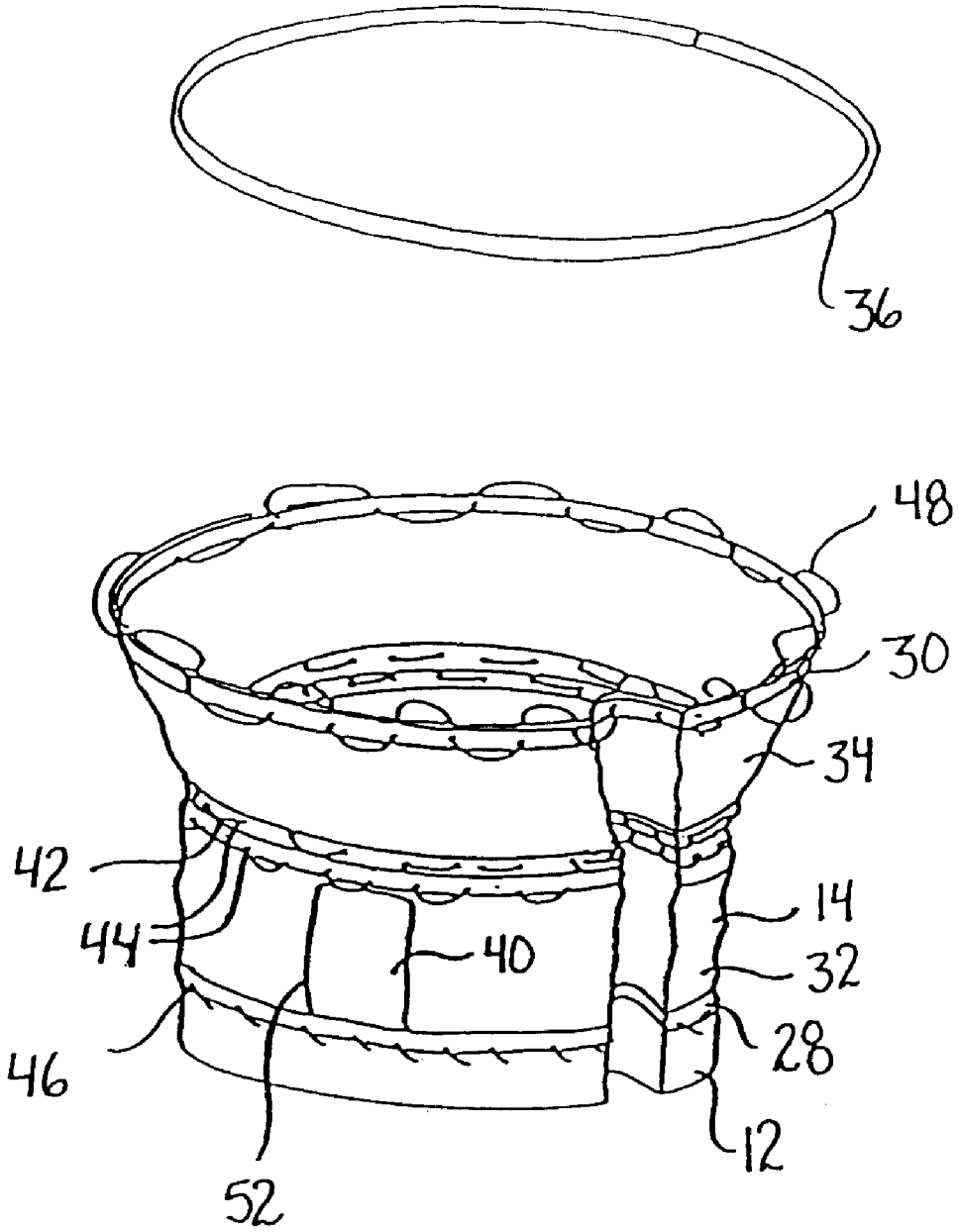
FIG. 3 is a perspective view of the apparatus illustrated in FIG. 1, with the covering secured to the base in accordance with the teachings of the preferred method of enclosing an oil drilling rig.
Figure 4:
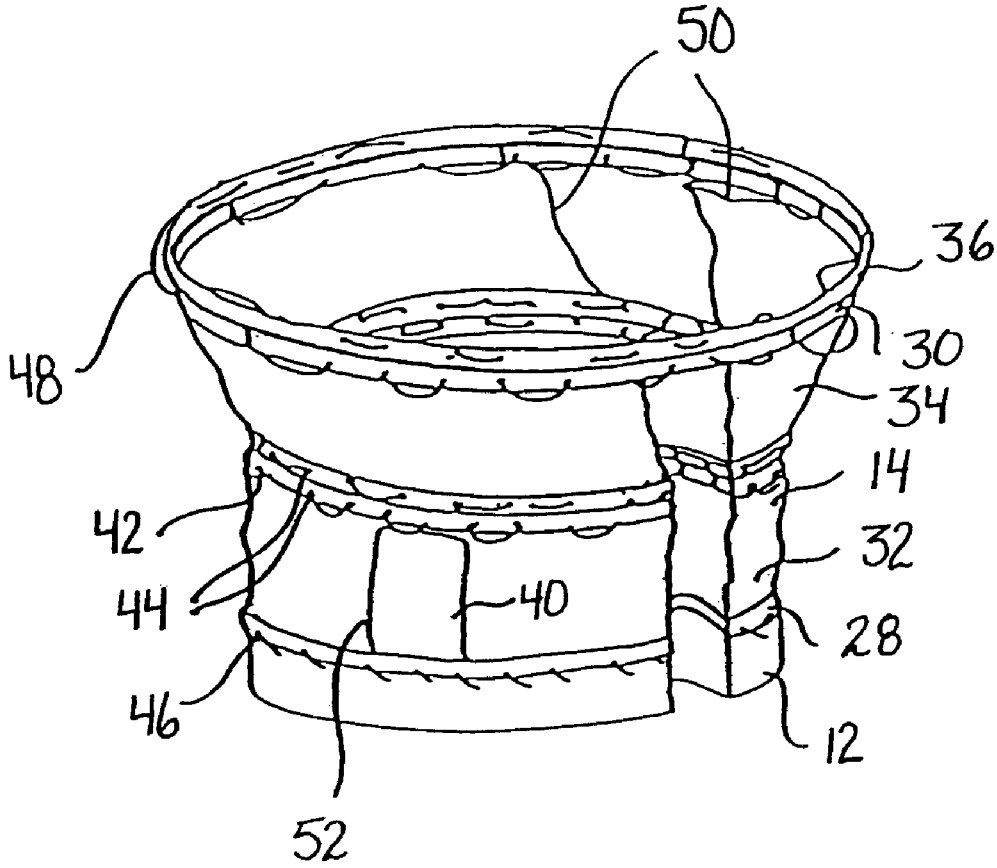
FIG. 4 is a perspective view of the apparatus illustrated in FIG. 1, with the covering secured to the frame in accordance with the teachings of the preferred method of enclosing an oil drilling rig.

Referring to FIG. 3, once secured together to form covering 14, first edge 28 of covering 14 is secured around a perimeter of base 12. A second cable 46 can be used to secure first edge 28 around perimeter of base 12 as shown in the illustrated embodiment, although it will be appreciated that other methods such as the use of carabineers can also be employed to secure first edge 28 to base 12. Referring to FIG. 4, second edge 30 of covering 14 is secured around a perimeter of frame 36 by a third cable 48, although it will be appreciated that other methods such as the use of carabineers can be used. In the illustrated embodiment, frame 36 has a circumference which is selectively adjustable so that the circumference can be increased or decreased to suit drilling rig 16. As frame 36 is adjusted, covering 14 can be also be adjusted to accommodate changes in the circumference of frame 36 by arranging folds 50 in upper portion 34 in covering 14.

Figure 5:
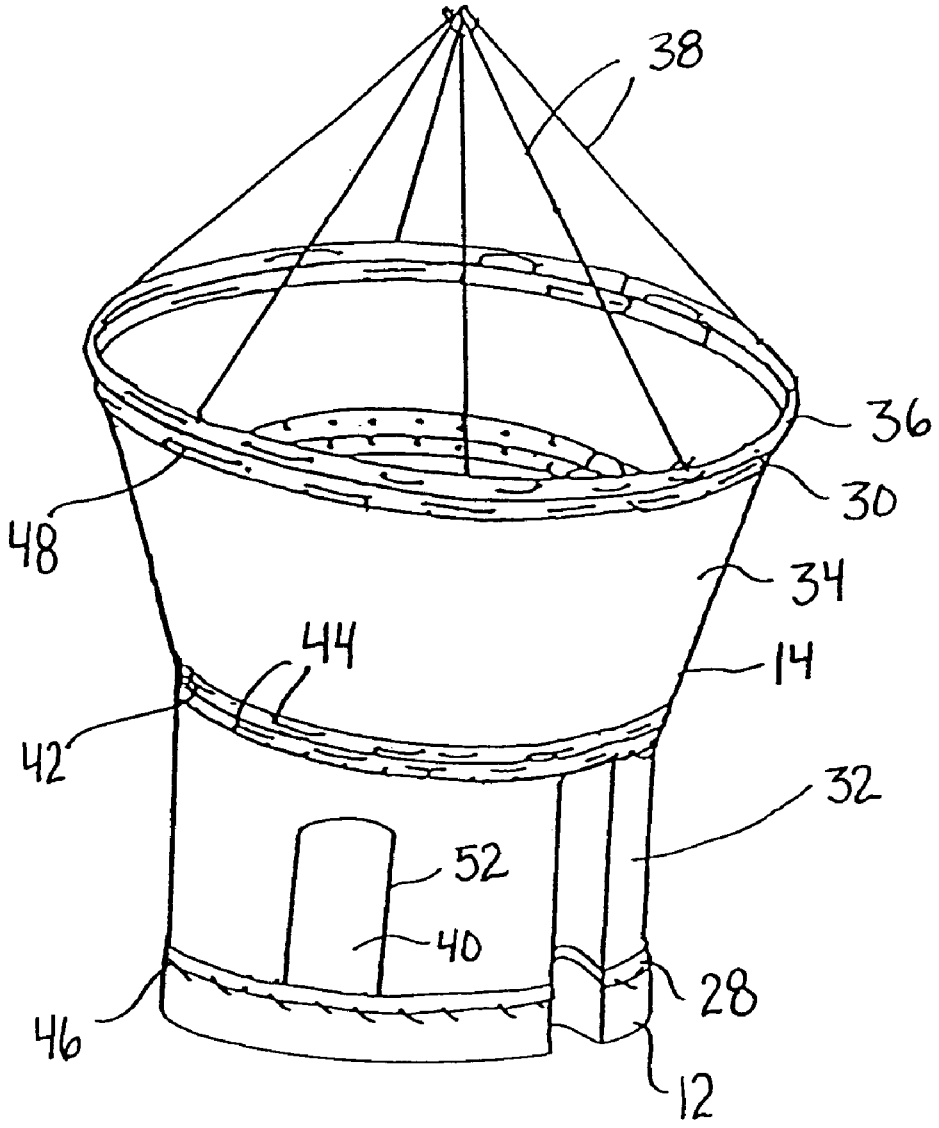
FIG. 5 is a perspective view of the apparatus illustrated in FIG. 1, with the second edge of the covering being raised to form the tubular enclosure in accordance with the teachings of the preferred method of enclosing an oil drilling rig.
Figure 6:
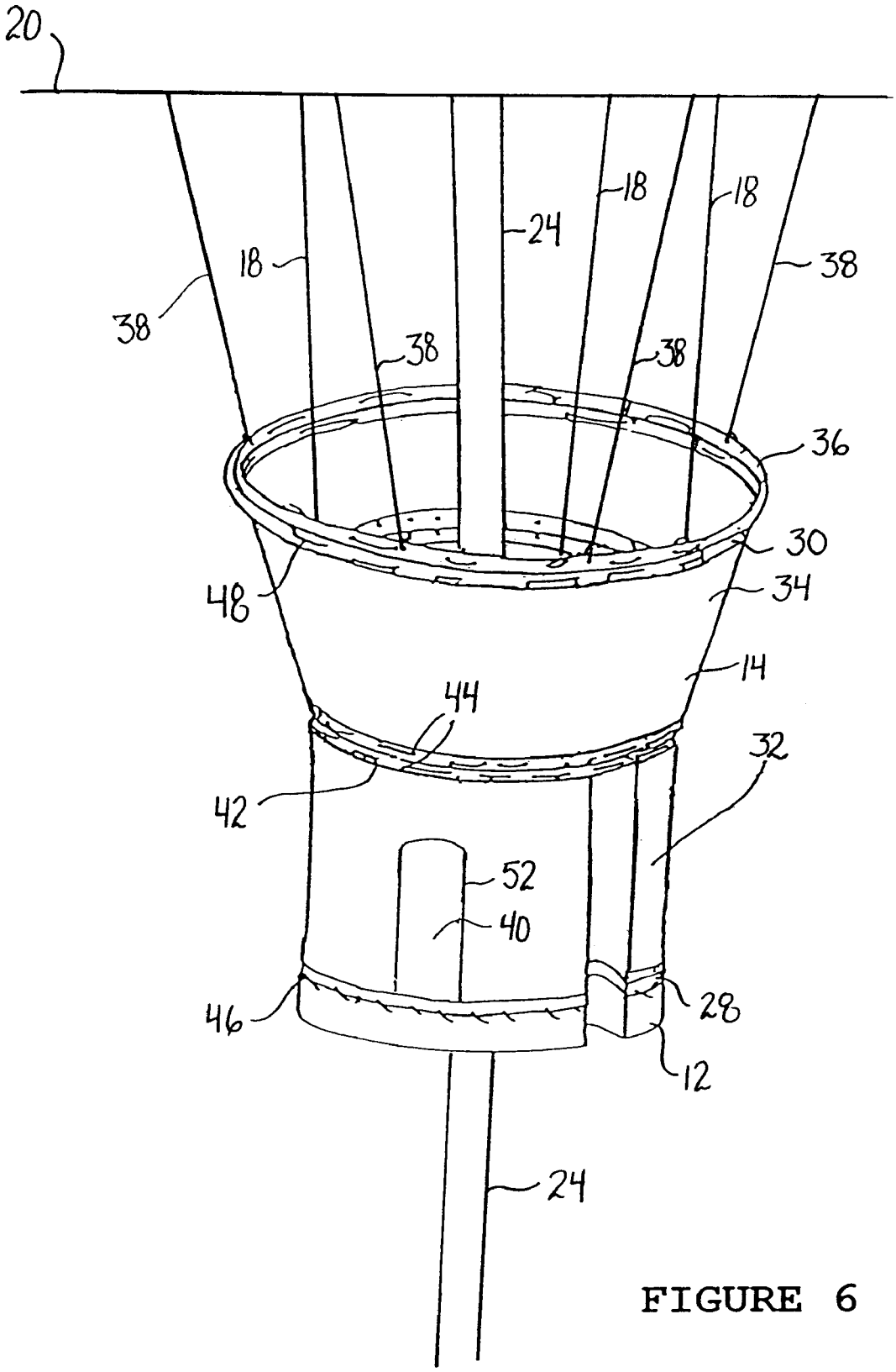
FIG. 6 is a perspective view of the apparatus illustrated in FIG. 1, installed on an oil drilling rig in accordance with the teachings of the preferred method of enclosing an oil drilling rig.

Referring to FIG. 1, base 12 is then secured to drilling rig 16 by suspending it by cables 18 at a position approximately 8 feet below platform 20 of drilling rig 16. Base 12 is also secured to pipe 24 by clamps 26. Referring to FIG. 5, frame 36 is lifted by cables 38 until covering 14 becomes substantially taut. If frame 36 is not used, then second edge 30 of covering 14 is secured to cables 38 and lifted until covering 14 becomes substantially taut. Referring to FIG. 6, cables 38 are then secured to platform to maintain frame 36 in spaced relation to base 12 with covering 14 in a substantially taut condition. If frame 36 is not used, then cables 38 are used to secure second edge 30 of covering 14 in spaced relation to base 12 with covering 14 in a substantially taut condition. In the illustrated embodiment, access opening 40 in covering 14 includes a zipper 52 which can be unzipped to allow personnel to enter and exit.

Referring to FIG. 6, once installed, covering 14 forms part of a method of enclosing area 10. Covering 14 works in conjunction with base 12 to contain oil so as to prevent oil from contaminating area 10 and the environment surrounding drilling rig 16. Furthermore, covering 14 is able to withstand strong prevailing winds that can otherwise carry oil from area 10 to surrounding environment.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of enclosing an oil drilling rig, comprising the steps of:

providing a base and a flexible sheet-form covering having a first edge and second edge;

securing the base to the oil drilling rig and securing the first edge of the covering around a perimeter of the base; and securing the second edge of the covering to the drilling rig in spaced relation to the base, thereby maintaining the covering in a substantially taut condition forming a tubular enclosure.

2. The method as defined in claim 1, the second edge of the covering being secured to a substantially planar peripheral frame.

3. The method as defined in claim 2, the frame being a telescopically adjustable annular frame.

4. The method as defined in claim 1, the covering having an access opening, thereby facilitating ease of ingress and egress by personnel.

5. The method as defined in claim 1, the base including an oil containment basin.

6. A method of enclosing an oil drilling rig, comprising the steps of:

providing a base with an oil containment basin, a substantially planar frame, and a flexible sheet-form covering having a first edge and second edge;

securing the base to the oil drilling rig and the first edge of the covering around a perimeter of the base;

securing the second edge of the covering around a perimeter of the frame; and suspending the frame from the drilling rig in spaced relation to the base with the covering in a substantially taut condition to form a tubular enclosure.

7. In combination:

an oil drilling rig;

a base secured to the oil drilling rig;

a flexible sheet-form covering having a first edge and second edge, the first edge of the covering being secured around a perimeter of the base, the second edge of the covering being secured to the drilling rig in spaced relation to the base, thereby maintaining the covering in a substantially taut condition forming a tubular enclosure.

8. The combination as defined in claim 7, the second edge of the covering being secured to a substantially planar peripheral frame.

9. The combination as defined in claim 8, wherein the frame is a telescopically adjustable annular frame.

10. The combination as defined in claim 7, wherein the covering has an access opening, thereby facilitating ease of ingress and egress by personnel.

11. The combination as defined in claim 7, wherein the base includes an oil containment basin.

12. In combination:

an oil drilling rig;

a base secured to the oil drilling rig, the base including an oil containment basin adapted to capture and contain any oil which falls onto the base;

a flexible sheet-form covering having a first edge and second edge, the first edge of the covering being secured around a perimeter of the base, the second edge of the covering being secured to a substantially planar peripheral frame, the frame being suspended from the drilling rig in spaced relation to the base, thereby maintaining the covering in a substantially taut condition forming a tubular enclosure.

13. The combination as defined in claim 12, wherein the covering has an access opening, thereby facilitating ease of ingress and egress by personnel.

14. The combination as defined in claim 12, wherein the frame is a telescopically adjustable annular frame.

* * * * *